US009038223B2

(12) United States Patent
Carson

(10) Patent No.: US 9,038,223 B2
(45) Date of Patent: May 26, 2015

(54) FOLDING KNIFE HAVING SEAT BELT CUTTER ON BLADE TANG

(71) Applicant: GB II Corporation, Tualatin, OR (US)

(72) Inventor: Harold Carson, Vine Grove, KY (US)

(73) Assignee: GB II CORPORATION, Tualatin, OR (US)

( * ) Notice: Subject to any disclaimer, the term of this patent is extended or adjusted under 35 U.S.C. 154(b) by 227 days.

(21) Appl. No.: 13/732,984

(22) Filed: Jan. 2, 2013

(65) Prior Publication Data

US 2013/0174351 A1 Jul. 11, 2013

Related U.S. Application Data

(60) Provisional application No. 61/583,537, filed on Jan. 5, 2012.

(51) Int. Cl.

| | |
|---|---|
| ***B26B 9/00*** | (2006.01) |
| ***B26B 1/02*** | (2006.01) |
| ***B26B 11/00*** | (2006.01) |

(52) U.S. Cl.

CPC ... *B26B 9/00* (2013.01); *B26B 1/02* (2013.01); *B26B 11/00* (2013.01); *B26B 11/006* (2013.01)

(58) Field of Classification Search

USPC ..... 7/118, 158, 161; 30/123, 143, 153, 155, 30/278, 280, 294, 309, 314, 317, 320, 321

See application file for complete search history.

(56) References Cited

U.S. PATENT DOCUMENTS

| | | | | |
|---|---|---|---|---|
| D152,727 | S | 2/1949 | Peterson | |
| 3,605,268 | A | 9/1971 | Cassell | |
| 5,485,677 | A | 1/1996 | Seber | |
| 5,581,895 | A * | 12/1996 | Jeffcoat | 30/294 |
| 5,845,404 | A * | 12/1998 | Jeffcoat | 30/125 |
| 6,658,743 | B2 | 12/2003 | Dudley et al. | |
| 6,725,545 | B2 * | 4/2004 | Frank | 30/155 |
| 6,789,323 | B2 * | 9/2004 | Moizis | 30/155 |
| D502,526 | S | 3/2005 | Rae | |
| D561,295 | S | 2/2008 | Taylor | |
| D570,180 | S | 6/2008 | Onion et al. | |
| 7,437,822 | B2 | 10/2008 | Flagg et al. | |
| 7,743,512 | B1 | 6/2010 | Whittemore | |
| D642,444 | S | 8/2011 | Kommer | |
| D657,435 | S | 4/2012 | Wilke | |
| 8,464,382 | B2 * | 6/2013 | Chu | 7/118 |
| 2005/0150115 | A1 * | 7/2005 | Hanna | 30/155 |

(Continued)

OTHER PUBLICATIONS

Notice of Allowance and Fee(s) Due, dated Jan. 14, 2013, issued by the U.S. Patent and Trademark Office for corresponding Design U.S. Appl. No. 29/410,241, filed Jan. 5, 2012, 6 pp.

(Continued)

*Primary Examiner* — David B Thomas

(74) *Attorney, Agent, or Firm* — Klarquist Sparkman, LLP

(57) ABSTRACT

The present invention relates to embodiments of a folding knife having a seat belt cutter on the blade tang. In one embodiment, a folding knife comprises a handle and a knife blade. The knife blade comprises a tang pivotably connected to the handle, and the blade is operable to pivot relative to the handle about a pivot axis extending through the tang between a closed position and an open position. The tang comprises an enlarged tang portion that extends outwardly from the handle when the blade is in the closed position, and the enlarged tang portion comprises a cutting portion.

19 Claims, 4 Drawing Sheets

(56) References Cited

U.S. PATENT DOCUMENTS

| | | | | |
|---|---|---|---|---|
| 2007/0186420 | A1* | 8/2007 | Koelewyn | 30/153 |
| 2012/0234142 | A1* | 9/2012 | Onion | 81/489 |

OTHER PUBLICATIONS

Design U.S. Appl. No. 29/410,241, filed Jan. 5, 2012, Carson.
Crosslock Buck Knives, published Aug. 16, 2000, available at http://questknives.4mg.com/Page301.htm, 1 page.

* cited by examiner

FOLDING KNIFE HAVING SEAT BELT CUTTER ON BLADE TANG

CROSS-REFERENCE TO RELATED APPLICATION

The present application claims the benefit of U.S. Provisional Application No. 61/583,537, filed Jan. 5, 2012, which is incorporated herein by reference.

FIELD

The present disclosure relates to embodiments of a folding knife having a seat belt cutting blade on the blade tang.

SUMMARY

The present disclosure concerns embodiments of a folding knife comprising a handle and a knife blade. In one representative embodiment, the knife blade comprises a tang pivotably connected to the handle, wherein the blade is operable to pivot relative to the handle about a pivot axis extending through the tang between a closed position and an open position. The tang comprises an enlarged tang portion that extends outwardly from the handle when the blade is in the closed position, and the enlarged tang portion comprises a cutting portion. The cutting portion can be configured to cut webbing material and heavy fabrics. In particular embodiments, the knife can be used as an emergency tool that can be used to cut a seat belt with the cutting portion on the enlarged tang portion.

In another embodiment, a folding knife comprises a handle and a knife blade pivotably connected to the handle. The knife blade comprises a cutting edge, an opposing edge opposite the cutting edge, and a tang. The blade is operable to pivot relative to the handle about a pivot axis extending through the tang between a closed position and an open position, and the tang comprises an enlarged tang portion that extends outwardly from the handle when the blade is in the closed position. The enlarged tang portion comprises a cutting portion having first and second scalloped portions formed in opposing sides of the enlarged tang portion.

Another embodiment concerns a method of cutting a material. The method comprises holding a folding knife having a blade, a handle, and a tang. The tang comprises an enlarged tang portion having a cutting portion, and the cutting portion comprises first and second scalloped portions formed in opposing sides of the enlarged tang portion. The blade is in a closed position such that a cutting edge of the blade is in the handle and the cutting portion of the enlarged tang portion extends from the handle. The method further comprises cutting the material with the cutting portion of the tang.

The foregoing and other objects, features, and advantages of the invention will become more apparent from the following detailed description, which proceeds with reference to the accompanying figures.

DETAILED DESCRIPTION

Figures 1, 6, 7:
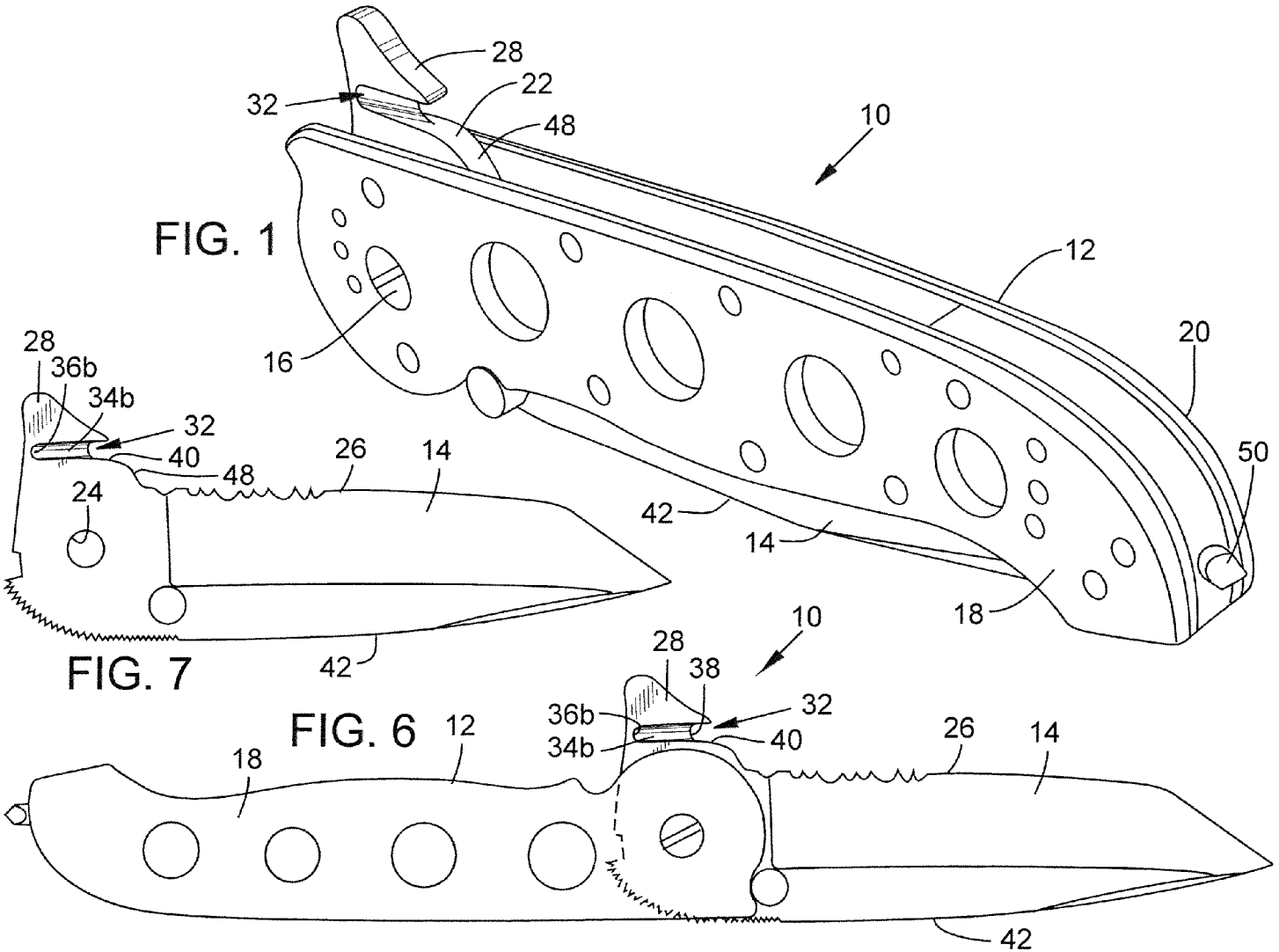
FIG. 1 is a perspective view of a knife, according to one embodiment, showing the blade in its closed position.
FIG. 6 is a side elevation view of the knife of FIG. 1 showing the blade in its open position.
FIG. 7 is a side elevation of the blade of the knife shown in FIG. 1.
Figure 3:
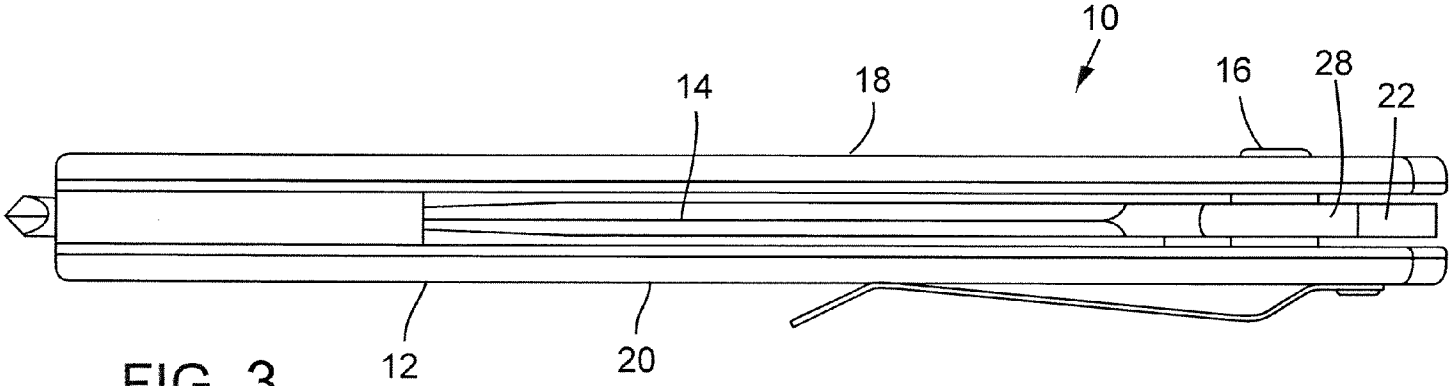
FIG. 3 is a top plan view of the knife of FIG. 1.

Referring to the figures, there is shown a folding knife 10, according to one embodiment, comprising a handle 12 and a blade 14 pivotably connected to the handle 12 in a conventional manner, such as by a pivot screw 16 that extends through the handle and the blade. The blade 14 can be pivoted about a pivot axis defined by the pivot screw 16 between a closed position (FIG. 1) and an open position for use (FIG. 6). The handle 12 in the illustrated embodiment comprises a first side portion 18 and an opposing, second side portion 20 that defines a cavity therebetween for receiving the blade 14 in the closed position, as shown in FIG. 3. The handle 12 can have a different configuration in alternative embodiments. For example, the handle 12 can comprise a single side portion connected to the blade. Various handle configurations are known in the art and can be implemented in the knife 10.

The blade 14 disassembled from the knife is shown in FIG. 7. As shown, the blade 14 comprises a tang 22 formed with a pivot hole or opening 24 that receives the pivot screw 16 (FIG. 1). The blade further includes a cutting edge 26 extending from the tang 22 to the tip of the blade and an opposing edge 42 opposite the cutting edge. In the embodiment shown, the opposing edge 42 is a non-sharpened, dull edge. However, in alternative embodiments, the opposing edge 42 may comprise a cutting edge similar to cutting edge 42.

Figure 4:
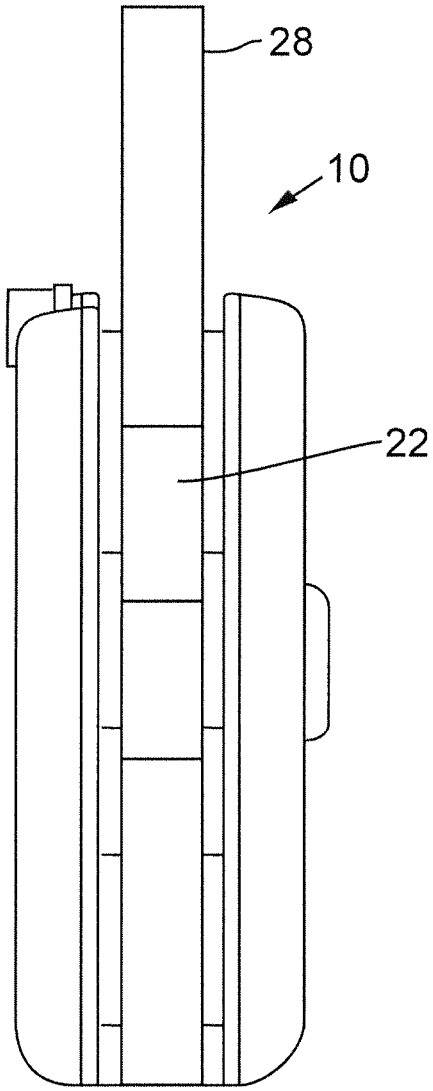
FIG. 4 is a rear elevation view of the knife of FIG. 1.

The tang 22 includes a projection, or enlarged tang portion, 28 that extends outwardly from the back edge of the handle 12 when the blade is in the closed position (see FIGS. 1 and 4). Thus, when the blade is closed, the enlarged tang portion is exposed at the back of the handle 12 so that it can be used in opening the blade. The enlarged tang portion 28 is referred to as a "flipper" because the blade can be opened by applying pressure with a finger to the enlarged tang portion in the counterclockwise direction shown in FIG. 2 (in the direction of arrow 30), causing the blade to "flip" open. When the blade is open (FIG. 6), the enlarged tang portion 28 extends from the front edge of the handle so as to serve as a blade guard that protects against the user's hand from slipping onto the cutting edge 26 of the blade during use.

The enlarged tang portion 28 is formed with an integral seat belt cutter, or cutting portion, 32 that can be used to cut a seat belt strap or other webbing material. The seat belt cutter 32 is integral in the sense that it is machined directly in the enlarged tang portion and does not comprise a separate blade mounted to the tang using mechanical fasteners, such as rivets or screws. The cutter 32 of the knife 10 can be used to cut a seat belt strap, such as when a driver or passenger of a vehicle is trapped within the vehicle after an accident and cannot activate the seat belt latch. In this manner, the knife 10 functions as an extraction or safety device to cut through seat belts in situations where the seat belt latch cannot be activated in the usual manner. The cutter 32 can also be used to cut through other types of webbing material or heavy fabrics (e.g., nylon webbing material) that cannot be cut easily with the conventional cutting edge 26 of the blade.

Figure 5:
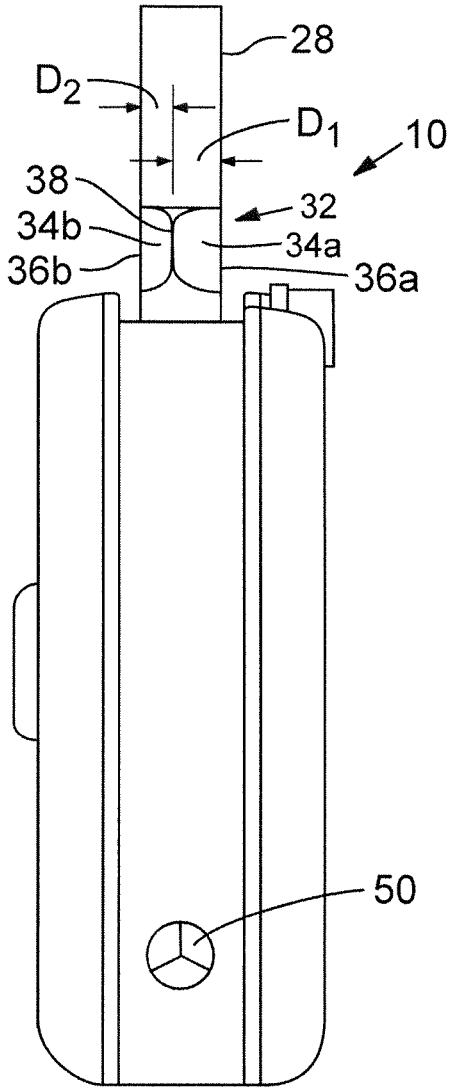
FIG. 5 is a front elevation view of the knife of FIG. 1.

The cutter 32 in the illustrated embodiment comprises opposing scalloped portions 34*a*, 34*b* formed in opposing sides of the tang portion 28. Each scalloped portion 34*a*, 34*b* extends lengthwise of the blade from a respective back edge 36*a*, 36*b* and converges with each other at a common, scalloped-shaped, sharpened front edge 38. In this manner, the height or depth of each scalloped portion 34*a*, 34*b* increases moving in a direction along the length of each scalloped portion from the back edge toward the common front edge. As best shown in FIG. 5, in the illustrated configuration, the first scalloped portion 34*a* has a depth D1 that is slightly greater than the depth D2 of the second scalloped portion 34*b* measured at the common front edge 38. In alternative embodiments, the first and second scalloped portions 34*a*, 34*b* are formed to be minor images of each other and have the same depth at the front edge 38.

Figure 2:
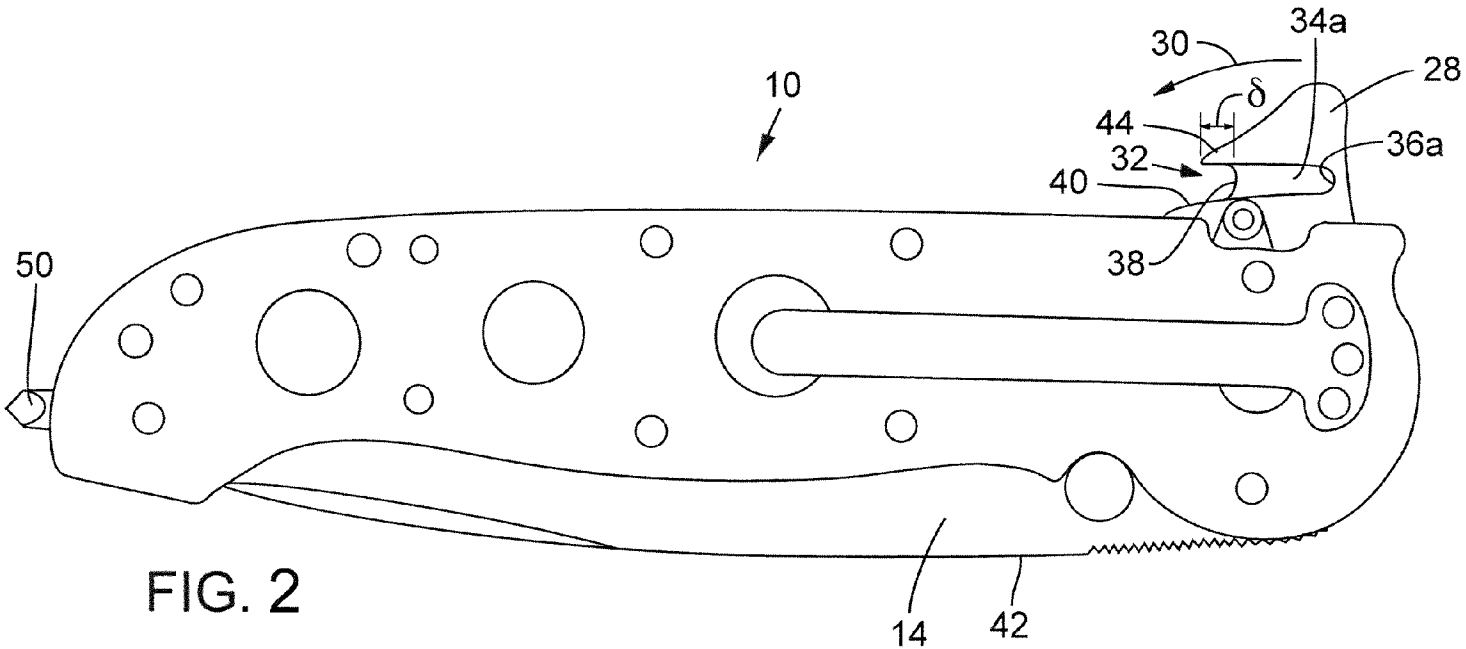
FIG. 2 is a side elevation view of the knife of FIG. 1.

The cutter 32 in the illustrated embodiment also is formed with a front receiving slot 40 that is sized to receive the seat belt strap (or other piece of material) to be cut. The front receiving slot 40 is defined by a lip portion 44 of the enlarged tang portion 28, which extends a distance δ beyond the front edge 38 of the cutter 32, as shown in FIG. 2. In this manner, the lip portion 44 helps to prevent material from slipping out of the front receiving slot 40 while directing the material toward the front edge 38. Also, the front receiving slot 40 isolates the sharpened front edge 38 from the outer peripheral edge of the enlarged tang portion, helping to reduce the risk of injury.

For safety purposes, the cutter 32 is used with the blade in the closed position so that the cutting edge 26 of the blade is covered by the handle. To cut a piece of material, the edge of the material is inserted into the slot 40 against the sharpened front edge 38. The user, holding the handle 12, pulls the knife 10 in the direction of the intended cut. The sharpened edge 38 is effective to cut through the material as the knife 10 is pulled in the direction of the cut. Additionally, for safety purposes, the sharpened front edge 38 is not continuous with the cutting edge 26 of the blade 14. Rather, front edge 38 and cutting edge 26 are separated by a non-sharpened portion 48 of the tang 22, as can be seen in FIGS. 1 and 7.

Figure 8:
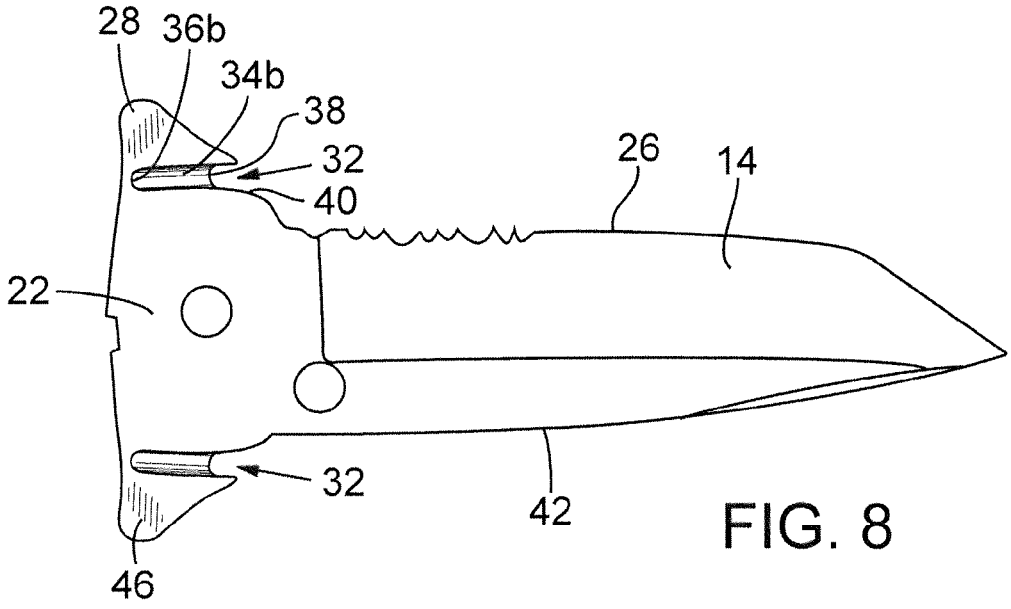
FIG. 8 is a side elevation view of another embodiment of a knife blade.
Figure 9:
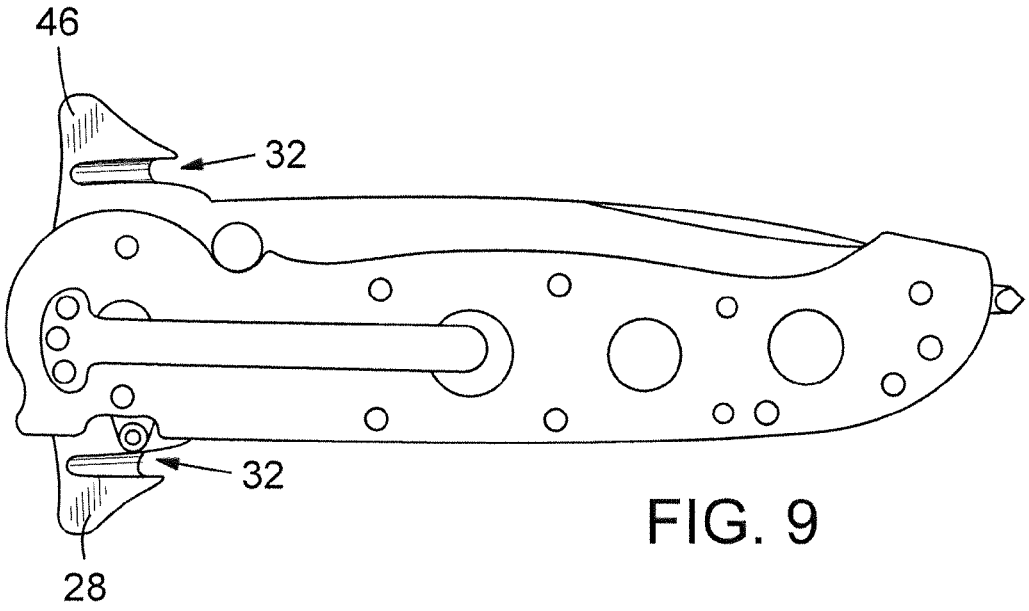
FIG. 9 is a side elevation view of another embodiment of a knife comprising the knife blade of FIG. 8.

In the illustrated embodiment, the enlarged tang portion 28 extends from the tang 22 on the same side of the blade as the cutting edge 26. In other embodiments, the enlarged tang portion 28 can extend from the tang on the same side of the blade as the opposing edge 42. In still other embodiments, the tang 22 can have a first enlarged tang portion 28 extending from the same side of the blade as the cutting edge and a second enlarged tang portion 46 extending from the same side of the blade as the opposing edge 42, as shown in FIGS. 8-9. Thus, in such an embodiment, both the first enlarged tang portion 28 and the second enlarged tang portion 46 can be formed with respective cutting portions 32, as shown in FIGS. 8-9.

The knife 10 can also have a window breaker 50 mounted at a convenient location on the handle or the blade. The window breaker 50 can be mounted on the end of the handle 12 opposite the pivot screw 16, as shown in the illustrated embodiment. The window breaker 50 desirably is made of a relatively hard material, such as tungsten carbide, and has a pointed tip as shown. The window breaker 50 can be used to break vehicle windows, such to extract vehicle occupants from a vehicle after an accident or to allow oneself to escape a vehicle after an accident. The window breaker 50 is effective to break a glass window by striking the window with the window breaker.

In an alternative embodiment, the blade tang 22 can be provided with a seat belt cutter that comprises a separately formed cutting blade that is mounted to the blade tang, such as with rivets or screws (i.e., a cutter that is not integral to the blade tang 22). In another embodiment, the integral seat belt cutter 32 described above can be implemented in tools other than folding knives. For example, a tool can comprise a handle and a tool element (e.g., a screwdriver blade, a bottle or can opener, a file, etc.) that is pivotably connected to the handle. The tool element can have an enlarged tang portion formed with an integral cutter 32 as described above. Also, the integral cutter 32 need not be formed in a tool element that is pivotably connected to a handle. For example, in another implementation, the integral cutter 32 can be formed in the handle of the tool or in a non-pivotable extension portion of the handle.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A folding knife, comprising:

a handle; and a knife blade comprising a tang pivotably connected to the handle, the blade being operable to pivot relative to the handle about a pivot axis extending through the tang between a closed position and an open position, the tang comprising an enlarged tang portion that extends through the handle and outwardly from the handle when the blade is in the closed position;

wherein the enlarged tang portion comprises a cutting portion.

2. The folding knife of claim 1, wherein the enlarged tang portion extends from the tang on the same side of the blade as a cutting edge of the blade.

3. The folding knife of claim 2, wherein the enlarged tang portion extends from the tang on the same side of the blade as an opposing edge opposite the cutting edge.

4. The folding knife of claim 1, wherein the tang comprises a first enlarged tang portion on the same side of the blade as a cutting portion of the blade and a second enlarged tang portion on the same side of the blade as an opposing edge opposite the cutting edge.

5. The folding knife of claim 4, wherein the first and second enlarged tang portions each comprise a cutting portion.

6. A folding knife, comprising:

a handle; and a knife blade pivotably connected to the handle and comprising a cutting edge, an opposing edge opposite the cutting edge, and a tang, the blade being operable to pivot relative to the handle about a pivot axis extending through the tang between a closed position and an open position, the tang comprising an enlarged tang portion that extends outwardly from the handle when the blade is in the closed position;

wherein the enlarged tang portion comprises a cutting portion, the cutting portion having first and second scalloped portions formed in opposing sides of the enlarged tang portion.

7. The folding knife of claim 6, wherein the first scalloped portion comprises a first depth to which the first scalloped portion extends into the large tang portion.

8. The folding knife of claim 7, wherein the second scalloped portion comprises a second depth to which the second scalloped portion extends into the large tang portion.

9. The folding knife of claim 8, wherein the first and second scalloped portions converge with each other at a common front edge.

10. The folding knife of claim 9, wherein the first depth is greater than the second depth.

11. The folding knife of claim 9, wherein the first depth is equal to the second depth.

12. The folding knife of claim 9, wherein the first and second depths increase moving in a direction along a length of each scalloped portion from a back edge of each scalloped portion toward the common front edge.

13. The folding knife of claim 9, wherein the cutting portion comprises a front receiving slot defined by a lip portion of the enlarged tang portion that extends beyond the common front edge of the cutting portion.

14. The folding knife of claim 13, wherein the front receiving slot is configured to receive a piece of material to be cut.

15. The folding knife of claim 6, wherein the folding knife further comprises a window breaker.

16. The folding knife of claim 15, wherein the window breaker is mounted on an end of the handle opposite the tang of the blade.

17. The folding knife of claim 6, wherein the cutting portion comprises a seat belt cutter.

18. A method of cutting a material, comprising:

holding a folding knife having a blade, a handle, and a tang, the tang comprising an enlarged tang portion having a cutting portion, the cutting portion comprising first and second scalloped portions formed in opposing sides of the enlarged tang portion, the blade being in a closed position such that a cutting edge of the blade is in the handle and the cutting portion of the enlarged tang portion extends from the handle;

cutting the material with the cutting portion of the tang.

19. The method of claim 18, wherein cutting the material comprises cutting a seatbelt.

* * * * *